US006636159B1

(12) United States Patent
Winnacker

(10) Patent No.: US 6,636,159 B1
(45) Date of Patent: Oct. 21, 2003

(54) BOREHOLE LOGGING APPARATUS FOR DEEP WELL DRILLINGS WITH A DEVICE FOR TRANSMITTING BOREHOLE MEASUREMENT DATA

(75) Inventor: Helmut Winnacker, Burgdorf (DE)

(73) Assignee: Precision Drilling Technology Services GmbH, Edemissen (DE)

( * ) Notice: Subject to any disclaimer, the term of this patent is extended or adjusted under 35 U.S.C. 154(b) by 611 days.

(21) Appl. No.: 09/624,960

(22) Filed: Jul. 25, 2000

(30) Foreign Application Priority Data

Aug. 19, 1999 (DE) ..... 199 39 262

(51) Int. Cl.[7] ..... G01V 3/00

(52) U.S. Cl. ..... 340/854.3; 340/855.4; 367/83; 73/152.43

(58) Field of Search ..... 340/854.3, 855.4; 367/83, 81; 73/152.43, 152.45, 152.46

(56) References Cited

U.S. PATENT DOCUMENTS 3,309,656 A 3/1967 Godbey
4,535,429 A * 8/1985 Russell et al. ..... 367/83
4,675,852 A * 6/1987 Russell et al. ..... 367/83
4,953,595 A * 9/1990 Kotlyar ..... 137/624.13
5,182,731 A 1/1993 Hoelscher et al.

FOREIGN PATENT DOCUMENTS

DE 41 26 249 2/1993
DE 196 27 719 1/1998

* cited by examiner

*Primary Examiner*—Timothy Edwards
(74) *Attorney, Agent, or Firm*—Collard & Roe, P.C.

(57) ABSTRACT

In a borehole logging apparatus (1) for deep well drillings having a device for transmitting measured data obtained while drilling from a borehole through the drilling fluid to the earth's surface, there is arranged in the upper end of a housing (2) a signal transmitter (13) comprising a beaker-shaped rotor (24) and a stator sleeve (25) surrounding said rotor. Fluid impinges on the signal transmitter (13) through a central feed pipe (15) surrounded by an exchangeable bypass ring (14) to which the complete current of drilling fluid is routed through a filter pipe (3) and through which part of the drilling fluid current is routed back into the drill string (6). From a set of bypass rings (14) of different bypass cross sections it is possible to select one suited for the particular on-site conditions and insert it into the logging apparatus (1) in order to obtain a significant signal through the signal transmitter (13).

10 Claims, 3 Drawing Sheets

Figure 1:
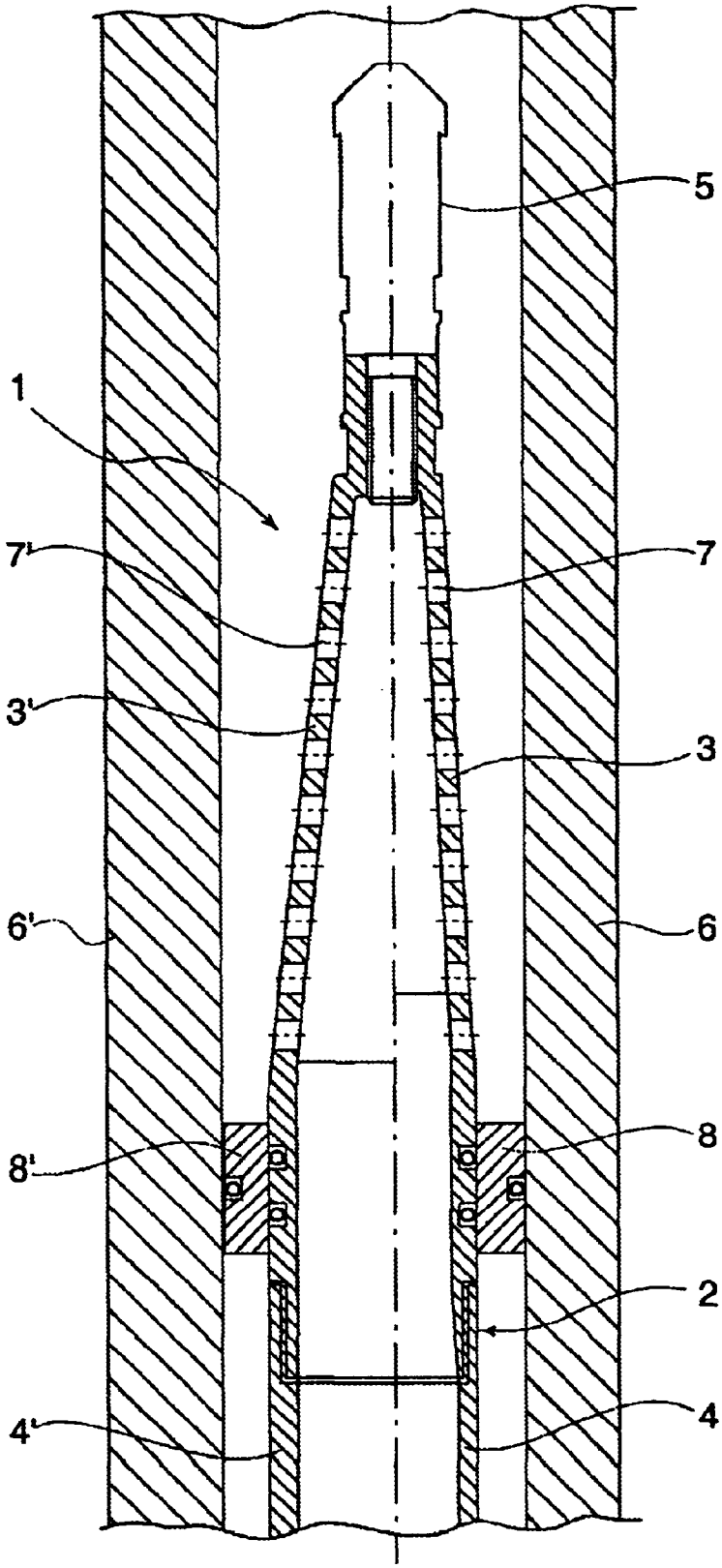

BOREHOLE LOGGING APPARATUS FOR DEEP WELL DRILLINGS WITH A DEVICE FOR TRANSMITTING BOREHOLE MEASUREMENT DATA

This invention relates to a borehole logging apparatus for deep well drillings, with a device for transmitting measured data obtained while drilling from a borehole through the drilling fluid to the earth's surface, with an elongated housing adapted for insertion in a drill string, a hydromechanical signal transmitter arranged in the housing and comprising a stator which is fixed to the housing and has at least one passage through which drilling fluid is routed from a side located upstream from the stator to a side located downstream from the stator, and a rotor mounted adjacent to the stator inside the housing for rotation about its longitudinal axis, said rotor having at least one continuous opening corresponding with the passage in the stator and being constructed to rotate either into a passing position in which the drilling fluid is allowed to pass through the passage and the opening aligned with it or into a throttling position in which a closed portion of the rotor throttles at least part of the flow through the passage in the stator, and a motor adapted to move the rotor repeatedly, in controlled intervals in response to signals indicative of the measured data to be transmitted, from the passing position into the throttling position and back into the passing position in order to generate in the drilling fluid a coded series of positive pressure pulses corresponding to the signals.

Apparatus of the type referred to are employed in particular in directional drilling in order to transmit measured data determined by measuring devices in the drill string while drilling to the earth's surface and, on the basis of these measured data, to permit the progress and direction of drilling to be influenced to the desired extent.

From DE 41 26 249 A1 there is known an apparatus of the type initially referred to in which the hydromechanical signal transmitter is arranged in the upper end of a cylindrical housing. On its outside the housing has radially outwardly extending guide ribs to center it in the drill string, passages being provided between the guide ribs to form a bypass around the signal transmitter. On both sides of a disk-shaped rotor inside the housing there are provided several cylindrical bores which extend parallel to the housing axis and form the passages for the drilling fluid which can be throttled by the rotor. Downstream from the rotor the bores lead into radially outwardly inclined outlet bores which emerge in the shell surface of the housing. The known apparatus has proven itself under practical conditions. Experience has shown, however, that the solid particles entrained in the drilling fluid lead to erosion in the bores on account of the flow velocity and the change of flow direction caused by the necessary inclination of the outlet bores, which limits the useful life of the stator. A further disadvantage of the known apparatus is to be seen in the fact that the cross section of the passages in the stator and the openings in the rotor needed to achieve a sufficient amplitude of the pressure pulses places a lower limit on the possible outer diameter of the housing and obstructs a desirable further reduction of the housing's outer diameter.

From U.S. Pat. No. 3,309,656 there is known an apparatus for the logging of boreholes while drilling and for the transmission of measured data in which continuous, frequency-modulated sonic waves transmitted by the drilling fluid are generated. This known apparatus is fixedly installed in the drill string and has at its upper end a transducer generating the sonic waves and comprising a stator sleeve equipped with longitudinal slots and a rotor rotatably mounted in the stator sleeve, the rotor having in its shell surface longitudinal grooves which are open at the top and whose lower ends lie in a passing position opposite the longitudinal slots so that the drilling fluid entering the longitudinal grooves of the rotor from above can exit at the lower end of the longitudinal grooves through the longitudinal slots of the stator. As the rotor is rotating, the longitudinal grooves are periodically closed by the wall portions of the stator located between the longitudinal slots so that sonic waves of varying frequency are generated in response to the rotational velocity of the rotor. Also in this known transducer part of the drilling fluid current is routed past the transducer through a bypass formed by a spider.

In a further borehole logging apparatus known from DE 196 27 719 A1 the signal transmitter is arranged at the lower end of the housing. In this apparatus the stator and the rotor of the signal transmitter are comprised of coaxially nesting sleeves which are open at their lower ends and have opposing longitudinal slots for creating passages adapted for controlled intermittent movement into an open position and a closed position.

It is an object of the present invention to provide a borehole logging apparatus of the type initially referred to which is equally suitable for use in small and large drill string bores and can be adapted by simple means to the particular drill string bore and the prevailing drilling fluid conditions so that with minimal throttling of the drilling fluid current the signal transmitter generates sufficiently significant pressure pulses for the transmission of signals. Furthermore, it is desirable that the borehole logging apparatus be insensitive to interference, long-lasting and easy to service.

This object is accomplished according to the present invention in that the housing has at its influx end a central inlet channel with an inlet opening and is sealed relative to the drill string by a sealing ring downstream from the inlet opening, that a feed pipe open at both ends with an outer diameter smaller than the inner diameter of the inlet channel is arranged to extend inside the inlet channel in the longitudinal direction of the inlet channel so that the current passing through it reaches the signal transmitter, that a bypass ring limiting the free annular cross section between the wall of the inlet channel and the feed pipe is arranged inside the inlet channel, and that downstream from the bypass ring the inlet channel has radial outlet openings through which a bypass current circulating around the feed pipe is routed out of the inlet channel into the drill string.

With the arrangement of the present invention it is possible to keep the outer diameter of the borehole logging apparatus so small as to be able to use the borehole logging apparatus with all deep drilling standard bores of coupling size 2⅞" and larger and to be able to withdraw the apparatus from the derrick. Furthermore, the borehole logging apparatus is suitable on account of its small outer diameter for drill string bend radii of 40 feet. By changing the bypass ring and, where applicable, employing a feed pipe of larger diameter for use in drill strings of larger bore it is easy to adapt the bypass current to the various cross sections and flow velocities so that a sufficiently significant pressure pulse for the transmission of signals is always achievable. Conversion of the borehole logging apparatus for adapting to the particular flow conditions and drill string bore can be performed by the operators on the derrick and is easy and quick to accomplish. According to the present invention, the housing of the borehole logging apparatus can be split for this purpose at the point where the bypass ring is mounted and at the point where the feed pipe is mounted by undoing a threaded joint. Provision can also be made for the signal transmitter to have a beaker-shaped rotor with a symmetrical arrangement of radial slots and a cylindrical shell surface as well as a correspondingly slotted stator sleeve surrounding the rotor, which are located directly adjacent to the exit opening of the feed pipe and can be withdrawn from the housing by splitting the housing at the point where the feed pipe is mounted. Hence it is also an easy matter to examine the rotor and the stator sleeve of the signal transmitter and, if worn, to replace them with new parts by splitting the housing. According to the invention, the rotor is connected by a plug-in coupling to the end of the drive shaft and in axial direction is mounted solely on the drive shaft. Rotor friction is thus kept small and with it the amount of energy required to generate signals.

According to a further proposal of the invention, the inlet opening of the inlet channel is formed by a filter pipe which has radial filter openings and carries a catch hook at its free, closed end. Coarse contaminants in the drilling fluid are held back by the filter pipe so that they are unable to obstruct the bypass and the signal transmitter.

As set forth in DE 41 26 249 A1, movement of the rotor can be effected by a direct-current motor with reversible direction of rotation, the rotor being rotated back and forth between the passing position limited by a first stop and the throttling position limited by a second stop. To be able to switch off the motor exactly upon reaching the respective stop position and so prevent energy losses which occur when the motor remains activated briefly upon reaching the stop, the present invention provides for an angle-of-rotation transducer causing the motor to reverse each time upon reaching or shortly before reaching the stop position. To ensure that the motor is still reversed upon reaching the stop position even if the angle-of-rotation transducer is defective, added provision can be made, in accordance with DE 41 26 249 A1, for sensing the rise in motor current upon reaching the stop position, using this data to reverse the motor. As a further safety measure provision can be made for a time control device which effects the reversal of the motor after a specified time window, opened at the beginning of a rotor movement, has elapsed.

Figure 2:
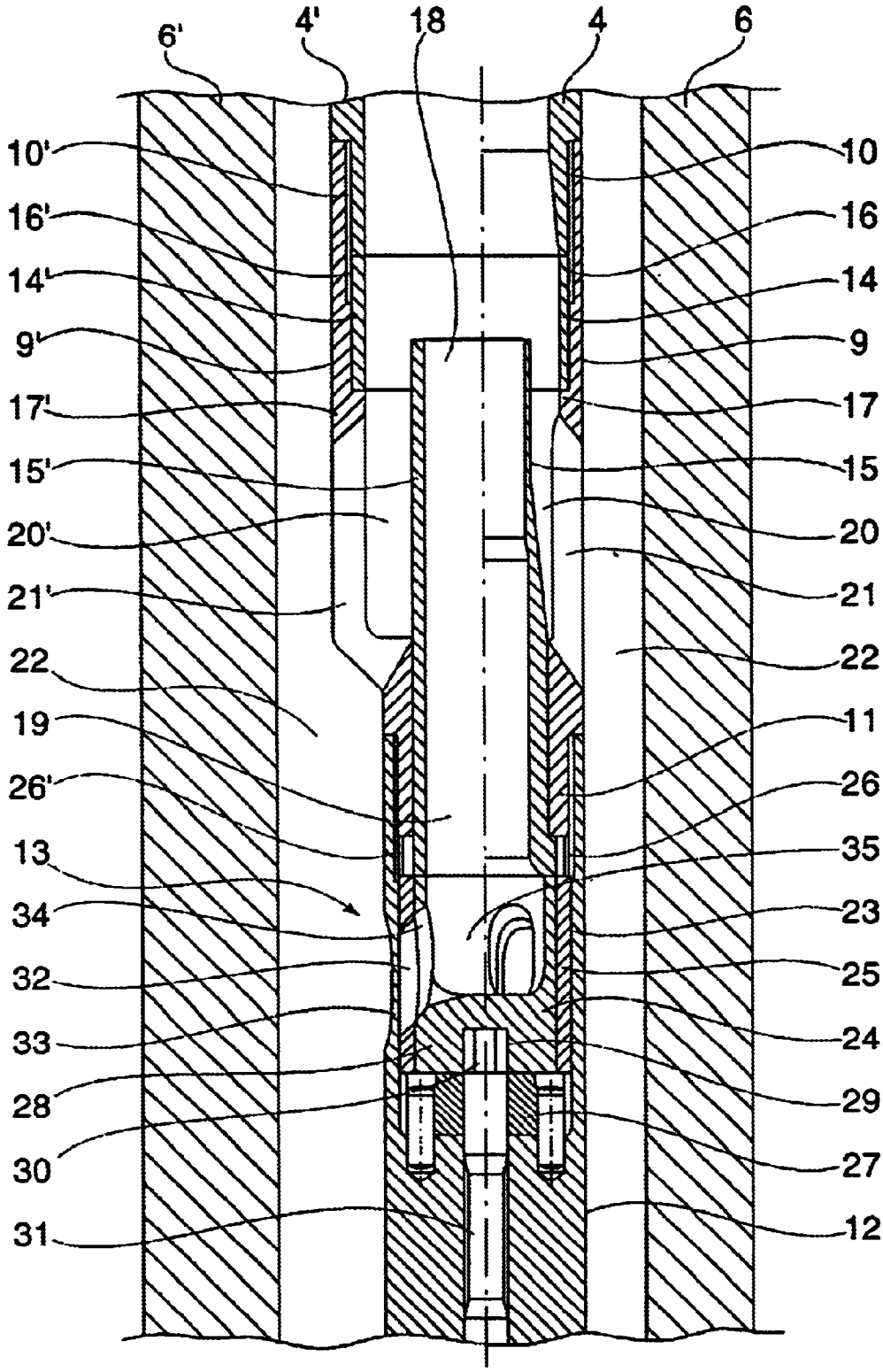
Figure 3A:
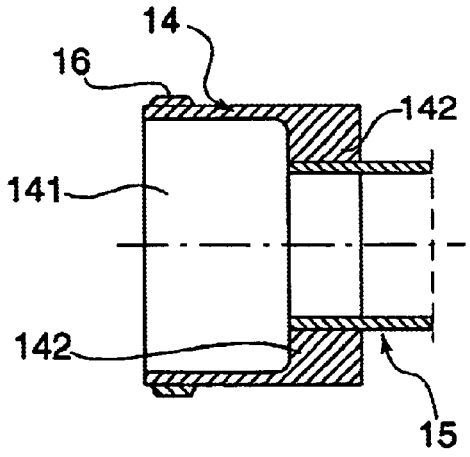
Figure 3B:
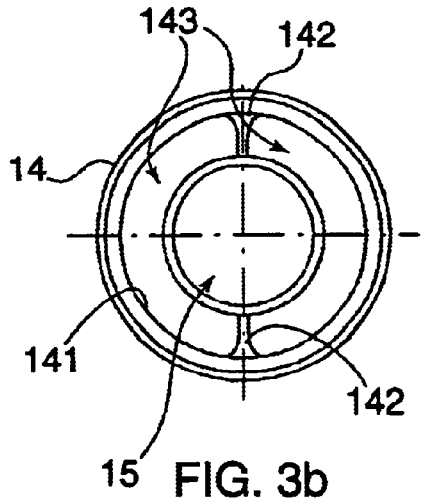
Figure 3C:
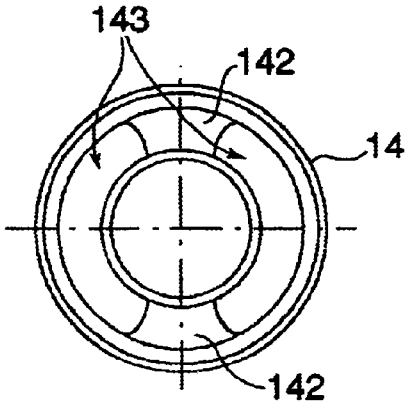
Figure 3D:
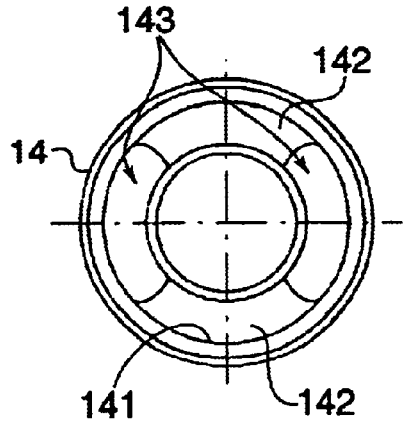
Figure 3E:
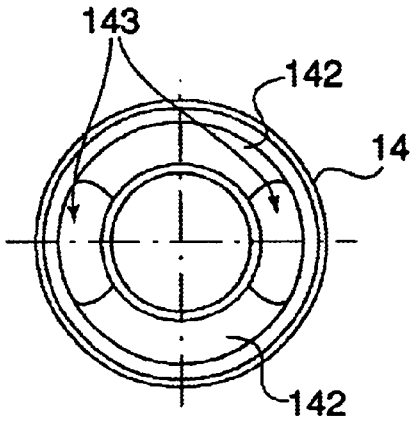
Figure 3F:
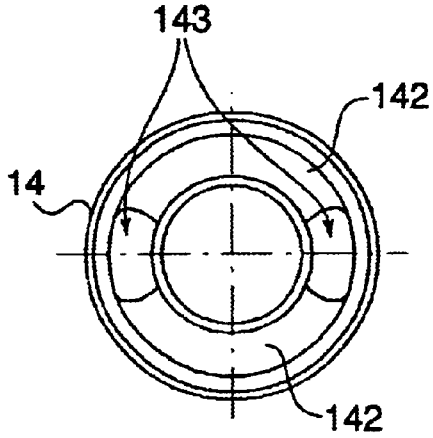

Further details of the present invention will become apparent from the subsequent description of embodiments illustrated in the accompanying drawings. In the drawings, FIG. 1 is a longitudinal sectional view of a section of a drill string and, located therein, the influx end portion of a borehole logging apparatus constructed in accordance with the present invention;

FIG. 2 is a longitudinal sectional view of a section of a drill string and that portion of a borehole logging apparatus of the present invention which contains the hydromechanical signal transmitter;

FIG. 3*a* is a longitudinal sectional view of the bypass ring of the borehole logging apparatus of FIG. 2; and FIG. 3*b* to FIG. 3*f* are views of various sizes of bypass ring intended for the borehole logging apparatus of FIG. 2.

The only partially illustrated borehole logging apparatus 1 has a housing 2 made of several housing parts screw threaded together in the form of an elongated cylindrical rod. Various units such as a measuring probe, measuring transducer, signal generator, signal transmitter and energy storage are arranged inside the housing 2. FIGS. 1 and 2 show two portions of the upper end part of the logging apparatus 1 in which the hydromechanical signal transmitter is arranged.

The influx end of the housing 2 shown in FIG. 1 is formed by a filter pipe 3, 3', which is screw connected to an adjoining tubular adapter 4, 4'. The filter pipe 3, 3' is conically tapered toward its free end and closed by a catch hook 5 screw threaded into the free tapped end of the filter pipe 3, 3'. The borehole logging apparatus 1 can be held on the catch hook 5 by means of a gripper and be moved on a rope into a drill string 6, 6' or be withdrawn from it again. The filter pipe 3, 3' has a multiplicity of openings 7, 7' extending radially through the pipe wall for enabling the drilling fluid pumped into the drill string to enter into the filter pipe 3, 3'. The cylindrical lower end of the filter pipe 3, 3' at the end close to the adapter 4, 4' is surrounded by a centering ring 8, 8' which is sealed in relation to the drill string 6, 6' and the filter pipe 3, 3' and closes the annulus between the filter pipe 3, 3' and the inner wall of the drill string 6, 6'. Hence the entire current of drilling fluid is forced to flow through the filter pipe 3, 3' and the adjoining portion of the housing 2.

The outer diameter of the centering ring 8, 8' has to be adapted to the given drill string diameter; a different centering ring 8, 8' is thus provided for each size of coupling. The right-hand half of FIG. 1 shows the construction for a drill string 6 with an internal diameter of 2 13/16" while the left-hand half shows the construction for a drill string 6' with an internal diameter of 3½" corresponding to coupling size 8". To adapt the borehole logging apparatus to the various drill string diameters, the filter pipe and the adapter are provided in two different constructions 3, 3' and 4, 4', respectively. The smaller constructions 3 and 4 shown in the right-hand half of the drawing are for coupling sizes up to 6½" while the larger constructions 3' and 4' shown in the left-hand half of the drawing are intended for coupling sizes of 8" and larger.

As becomes apparent from FIG. 2, adapter 4, 4' is adjoined in flow direction by a bypass element 9, 9' which like the adapter 4, 4' exists as a small construction 9 shown in the right-hand half of the drawing and as a large construction 9' shown in the left-hand half of the drawing, with construction 9 being intended for drill strings of small diameter and construction 9' for drill strings of large diameter. The bypass element 9, 9' has at its end close to the adapter 4, 4' a tapped hole 10, 10' which is in threaded engagement with that end of the adapter 4, 4' equipped with an external thread. The opposite end 11 of the bypass element 9, 9' has its external thread in threaded engagement with the tapped end portion of a sleeve-shaped housing part 12 in which the hydromechanical signal transmitter 13 is located. Inside the bypass element 9, 9' are a bypass ring 14, 14' and a feed pipe 15, 15' in a coaxial arrangement. The bypass ring 14, 14' is screwed with a threaded portion 16, 16' into the tapped hole 10, 10' and rests in axial direction against a shoulder 17, 17' of the bypass element 9, 9'. The feed pipe 15, 15' projects with its upper end 18 into the bypass ring 14, 14'. At its lower end 19 the feed pipe 15, 15' has an externally threaded collar 26, 26' for securing it in the bore of the bypass element 9, 9'. Between its ends 18, 19 the feed pipe 15, 15' is surrounded by an annulus 20, 20' which is formed by the bypass element 9, 9' and communicates with the drilling fluid channel 22 of the drill string 6, 6' through several radial outlet openings 21, 21' extending in longitudinal direction in the wall of the bypass element 9, 9'. On the left-hand construction 9' of the bypass element the annular cross section of the annulus 20' is approximately two and a half times bigger than that of the annulus 20 of the bypass element 9 shown in the right-hand half. The bypass ring 14, 14' and the feed pipe 15, 15' are each adapted to the two different constructions 9 and 9' of the bypass element.

Directly adjoining the feed pipe 15, 15' in the sleeve bore 23 of the housing part 12 there is a cylindrical, beaker-shaped rotor 24 and a stator sleeve 25 surrounding the rotor 24, which combine to form the signal transmitter 13. The stator sleeve 25 is axially fixed in place in the housing part 12 between the end 19 of the feed pipe 15, 15' at the one end and an annular disk 27 non-rotatably mounted on the bottom of the sleeve bore 23 at the other end and is nonrotatably held in a defined angular position inside the housing part 12 by a claw having positive engagement with a recess in the annular disk 27. The rotor 24 is shorter in length than the stator sleeve 25 and is likewise located between the end 19 of the feed pipe 15, 15' and the annular disk 27. In its bottom 28 opposite the annular disk 27 the rotor 24 has a polygonal coupling bore 29 into which the polygonal end of a drive shaft 31, constructed as a coupling journal 30, engages with zero play. The coupling bore 29 and the coupling journal 30 are coordinated in length so that the coupling journal 30 bearing with its end in axial direction against the bottom 28 holds the rotor 24, which is acted upon by fluid from above, in a central position between the end 19 of the feed pipe 15, 15' and the annular disk 27. Hence the axial ends of the rotor 24 are not in frictional contact with the opposite neighboring surfaces. The drive shaft 31 is mounted with zero play in axial direction in the lower adjoining portion of the housing part 12, not shown, by means of two rolling thrust bearings. The rotary motion of the rotor 24 is limited to an angle of rotation of 45° by claw-type projections on its bottom 28, which engage in recesses in the annular disk 27.

In the wall of the stator sleeve 25 provision is made for a symmetrical arrangement of passages 32 constructed as slots extending in axial direction. Opposite the passages 32 are openings 33 of corresponding size in the wall of the housing part 12. Between the passages 32 and the openings 33 are closed wall portions of a width exceeding the width of the passages 32 and openings 33 significantly. The edges of the passages 32 and openings 33 are inclined in accordance with the flow profile. In the illustrated position of the rotor 24 the passages 32 are opposed by openings 34 which penetrate the wall of the rotor 24 and are constructed likewise as axially parallel slots. The openings 34 are separated from each other by closed wall portions 35. The size of the openings 34 corresponds to that of the passages 32, and the edges of the openings 34 are inclined likewise in the direction of flow. The passages 32 and the wall portions 35 are coordinated in width so that the passages 32 can be fully closed by the wall portions 35 with one rotation of the rotor 24 through the predetermined angle of rotation of 45°.

A reversible direct-current motor linked to the drive shaft 31 by means of a reduction gear and a flexible coupling is used for driving the rotor 24. To generate a signal the direct-current motor is powered by current of changing direction so that it periodically reverses its direction of rotation, moving the rotor 24 alternately into the illustrated passing position and into the 45°-offset closing position in which the wall portions 35 close the passages 32. A digital angle-of-rotation transducer is preferably provided on the motor shaft to switch off the direct-current motor upon reaching the respective limit position of the angle of rotation.

In the passing position of the rotor 24 the current of drilling fluid pumped through the drill string 6, 6' and entering the bypass ring 14, 14' through the filter pipe 3 and the adapter 4, 4' can flow on the one hand along the outside of the feed pipe 15, 15' and through the outlet openings 21, 21' and on the other hand through the feed pipe 15, 15', the openings 24, the passages 32 and the openings 33 back into the drill string 6 and down to the drill bit. When the rotor 24 is rotated into the closing position, the cross section of flow of the signal transmitter 13 is obstructed. This leads upstream from the signal transmitter 13 to a sudden rise of pressure in the drilling fluid current which is propagated up to the earth's surface where it can be recorded by a receiver. When the rotor 24 is rotated back into the passing position, the entire cross section of flow is again available for the drilling fluid current. The pressure drops back to its previous level, which can be measured likewise at the earth's surface. By generating such pressure changes in rapid succession it is possible to transmit measurement signals from the logging apparatus in digital form as pressure pulses through the drilling fluid to the earth's surface.

A certain volumetric relationship between the bypass current, which circulates around the signal transmitter 13, and the signal current, which is routed through the signal transmitter 13, is required according to the given drilling fluid conditions in order to generate clear, easily transmittable and interference-proof pressure pulses. To be able to perform an in-situ adaptation of this volumetric relationship to the particular conditions by simple means, a corresponding set of bypass rings 14, 14' with various bypass cross sections is provided for each of the two illustrated sizes 9,9' of the bypass element and 15, 15' of the feed pipe. A set of various bypass rings 14 is shown in the FIGS. 3*a* to 3*f*. In all sizes the bypass rings 14 have radially inwardly extending, mutually opposite ribs 142 in their bore 141, whose circumferential dimension is smallest on the bypass ring of FIG. 3*b* and biggest on the bypass ring of FIG. 3*f*. Similarly, the free annular cross sections 143 between the ribs 142, which determine the flow of the bypass current, are biggest on the bypass ring 14 of FIG. 3*b* and smallest on the bypass ring 14 of FIG. 3*f*. The free annular cross sections of the bypass rings 14 shown in FIGS. 3*c*, 3*d* and 3*e* lie graduated between these limits. At their radial inner edge the ribs 142 have cylindrical guide surfaces against which the feed pipe 15 rests.

To exchange a bypass ring 14 the housing 2 of the borehole logging apparatus 1 is split at the threaded joint connecting the adapter 4 to the bypass element 9 and the existing bypass ring is replaced with a bypass ring of different size. Since the bypass rings 14 are held by a threaded portion 16 in the tapped hole 10 of the bypass element 9 it is an easy matter to remove and insert them by turning with a tool.

To examine the rotor 24 and the stator sleeve 25 and replace them if worn it suffices to split the housing 2 at the threaded joint between the bypass element 9 and the housing part 12. The rotor 24 and the stator sleeve 25 are then freely accessible and can be withdrawn axially from the housing part 12. The feed pipe 15 can be withdrawn likewise by splitting the housing 2 at this point.

What is claimed is:

1. A borehole logging apparatus for deep well drillings, with a device for transmitting measured data obtained while drilling from a borehole through the drilling fluid to the earth's surface, with an elongated housing adapted for insertion in a drill string, a hydromechanical signal transmitter arranged in the housing and comprising a stator which is fixed to the housing and has at least one passage through which drilling fluid is routed from a side located upstream from the stator to a side located downstream from the stator, and a rotor mounted adjacent to the stator inside the housing for rotation about its longitudinal axis, said rotor having at least one continuous opening corresponding with the passage in the stator and being constructed to rotate either into a passing position in which the drilling fluid is allowed to pass through the passage and the opening aligned with it or into a throttling position in which a closed portion of the rotor throttles at least part of the flow through the passage in the stator, and a motor adapted to move the rotor repeatedly, in controlled intervals in response to signals indicative of the measured data to be transmitted, from the passing position into the throttling position and back into the passing position in order to generate in the drilling fluid a coded series of positive pressure pulses corresponding to the signals, characterized in that the housing has at its influx end a central inlet channel with an inlet opening and is sealed relative to the drill string by a sealing ring downstream from the inlet opening, that a feed pipe open at both ends with an outer diameter smaller than the inner diameter of the inlet channel is arranged to extend inside the inlet channel in the longitudinal direction of the inlet channel so that the current passing through it reaches the signal transmitter, that a bypass ring limiting the free annular cross section between the wall of the inlet channel and the feed pipe is arranged inside the inlet channel, and that downstream from the bypass ring the inlet channel has radial outlet openings through which a bypass current circulating around the feed pipe is routed out of the inlet channel into the drill string.

2. The borehole logging apparatus as claimed in claim 1, characterized in that a set of interchangeable bypass rings is provided which differ from each other in the size of their bypass cross section.

3. The borehole logging apparatus as claimed in claim 1, characterized in that the housing is adapted to be split at the point where the bypass ring is mounted and at the point where the feed pipe is mounted by undoing a threaded joint.

4. The borehole logging apparatus as claimed in claim 1, characterized in that the signal transmitter has a beaker-shaped rotor with a symmetrical arrangement of radial openings and a cylindrical shell surface as well as a stator sleeve surrounding the rotor and having passages opening into the drilling fluid channel of the drill string, said passages being movable into registration with said openings.

5. The borehole logging apparatus as claimed in claim 1, characterized in that the rotor and the stator sleeve are located directly adjacent to the exit opening of the feed pipe and can be withdrawn from the housing by splitting the housing at the point where the feed pipe is mounted.

6. The borehole logging apparatus as claimed in claim 1, characterized in that the rotor is connected by a plug-in coupling to the end of the drive shaft and in axial direction is mounted solely on said drive shaft.

7. The borehole logging apparatus as claimed in claim 1, characterized in that the inlet opening of the inlet channel includes a filter pipe having radial filter openings and carrying a catch hook at its free, closed end.

8. The borehole logging apparatus as claimed in claim 1, characterized in that movement of the rotor is effected by a direct-current motor with reversible direction of rotation, said rotor being rotated back and forth between the passing position limited by a first stop and the throttling position limited by a second stop, with provision being made for an angle-of-rotation transducer causing deactivation or reversal of the direction of rotation of the direct-current motor each time upon reaching or shortly before reaching the stop position.

9. The borehole logging apparatus as claimed in claim 8, characterized in that provision is made for a sensing device sensing the rise in motor current upon the rotor reaching the stop position.

10. The borehole logging apparatus as claimed in claim 8, characterized in that provision is made for a sensing device sensing the time required by the rotor to travel through the angle of rotation defined by the stops.

* * * * *